US008747650B2

(12) United States Patent
Van Leeuwen et al.

(10) Patent No.: US 8,747,650 B2
(45) Date of Patent: Jun. 10, 2014

(54) ENGINE LUBRICANT WITH ENHANCED THERMAL STABILITY

(75) Inventors: Jeroen Van Leeuwen, Barandrecht (NL); Peter Kleijwegt, Heinenoord (NL)

(73) Assignee: Chevron Oronite Technology B.V., Rotterdam (NL)

( * ) Notice: Subject to any disclaimer, the term of this patent is extended or adjusted under 35 U.S.C. 154(b) by 1297 days.

(21) Appl. No.: 11/614,584

(22) Filed: Dec. 21, 2006

(65) Prior Publication Data

US 2008/0153722 A1 Jun. 26, 2008

(51) Int. Cl.

| | |
|---|---|
| ***C10G 71/00*** | (2006.01) |
| ***C10M 169/04*** | (2006.01) |
| ***C10M 137/10*** | (2006.01) |
| ***C10M 159/24*** | (2006.01) |
| ***C07C 43/20*** | (2006.01) |
| ***C10M 159/22*** | (2006.01) |

(52) U.S. Cl.

USPC ..... 208/18; 208/19; 508/287; 508/369; 508/390; 508/554; 508/561; 508/574

(58) Field of Classification Search

USPC ..... 508/149, 110, 152, 389, 554, 561, 390, 508/287; 184/6.5; 208/18, 19

See application file for complete search history.

(56) References Cited

U.S. PATENT DOCUMENTS

| | | | | |
|---|---|---|---|---|
| 3,852,207 | A | 12/1974 | Stangeland et al. | |
| 4,943,672 | A | 7/1990 | Hammer et al. | |
| 5,059,299 | A | 10/1991 | Cody et al. | |
| 6,562,230 | B1 | 5/2003 | O'Rear et al. | |
| 6,730,638 | B2 | 5/2004 | Farng et al. | |
| 6,833,065 | B2 | 12/2004 | O'Rear | |
| 7,374,658 | B2 * | 5/2008 | Rosenbaum et al. | 208/18 |
| 2003/0158048 | A1 * | 8/2003 | Farng et al. | 508/194 |
| 2004/0178118 | A1 | 9/2004 | Rosenbaum et al. | |
| 2004/0235682 | A1 * | 11/2004 | Van Dam et al. | 508/192 |
| 2005/0077209 | A1 * | 4/2005 | Miller et al. | 208/96 |
| 2005/0098476 | A1 * | 5/2005 | Miller | 208/19 |
| 2005/0107269 | A1 | 5/2005 | Yagishita et al. | |
| 2005/0241990 | A1 * | 11/2005 | Ziemer et al. | 208/19 |
| 2005/0245402 | A1 * | 11/2005 | Yagishita | 508/185 |
| 2006/0014653 | A1 | 1/2006 | Busse et al. | |
| 2006/0052254 | A1 | 3/2006 | Shaw | |
| 2006/0058200 | A1 | 3/2006 | Shaw et al. | |
| 2006/0068999 | A1 | 3/2006 | Shaw et al. | |
| 2006/0116300 | A1 | 6/2006 | Arrowsmith et al. | |
| 2006/0157384 | A1 | 7/2006 | Adams et al. | |
| 2006/0199743 | A1 | 9/2006 | Rosenbaum et al. | |
| 2006/0201852 | A1 * | 9/2006 | Rosenbaum et al. | 208/19 |
| 2006/0205610 | A1 * | 9/2006 | Rosenbaum et al. | 508/110 |
| 2006/0247138 | A1 * | 11/2006 | Rosenbaum et al. | 508/110 |
| 2006/0258549 | A1 * | 11/2006 | Habeeb et al. | 508/459 |
| 2006/0276350 | A1 * | 12/2006 | Habeeb et al. | 508/192 |
| 2006/0281643 | A1 * | 12/2006 | Habeeb et al. | 508/192 |
| 2006/0293193 | A1 * | 12/2006 | Rosenbaum et al. | 508/110 |
| 2007/0117724 | A1 * | 5/2007 | Cartwright | 508/460 |
| 2007/0117726 | A1 * | 5/2007 | Cartwright | 508/525 |
| 2007/0138053 | A1 * | 6/2007 | Baillargeon | 208/19 |
| 2007/0142242 | A1 * | 6/2007 | Gleeson et al. | 508/221 |
| 2007/0142247 | A1 * | 6/2007 | Baillargeon et al. | 508/279 |
| 2008/0146473 | A1 * | 6/2008 | Van Leeuwen et al. | 508/287 |

FOREIGN PATENT DOCUMENTS

| | | |
|---|---|---|
| GB | 2416775 | 2/2006 |
| JP | 2005306913 A | 11/2005 |
| WO | WO 00/14187 | 3/2000 |
| WO | WO 2008/013754 | 1/2008 |
| WO | 2008055975 A1 | 5/2008 |

OTHER PUBLICATIONS

International Search Report issued in counterpart Singapore Patent Application No. 200718910-3, (2009).
International Search Report issued in counterpart European Patent Application No. 07 25 4959, (2008).

* cited by examiner

*Primary Examiner* — Vishal Vasisth

(57) ABSTRACT

Provided are formulations, methods of making, and methods of using one or more Fischer-Tropsch Base Oils of the present invention in a low sulfur, low sulfated ash, and low phosphorus engine lubricant to enhance thermal stability of the lubricant as well as the high-temperature performance of an engine housing the lubricant.

52 Claims, No Drawings

ENGINE LUBRICANT WITH ENHANCED THERMAL STABILITY

The present invention relates to an automotive engine lubricating oil composition. More specifically, the present invention relates to a lubricating oil composition comprising a major amount of at least one Fischer-Tropsch Base Oil ("FTBO"), and having reduced levels of sulfated ash, phosphorus and sulfur (low "SAPS"). That composition has improved thermal stability over similar engine lubricating oil compositions comprising conventional base oils.

Environmental concerns have led to continued efforts to reduce the emissions of carbon monoxide (CO), hydrocarbon and nitrogen oxide ($NO_x$) from compression-ignited (diesel-fueled) and spark-ignited (gasoline-fueled) internal combustion engines. There have also been continued efforts to reduce the particulate emissions from compression-ignited internal combustion diesel engines. To meet the contemporary emission standards for passenger cars and other vehicles, original equipment manufacturers (OEMs) have been applying exhaust gas after-treatment devices. Such exhaust gas after-treatment devices include, but are not limited to, catalytic converters and/or particulate traps.

Catalytic converters typically contain one or more oxidation catalysts, $NO_x$ storage catalysts, and/or $NH_3$ reduction catalysts. The catalysts contained therein generally comprise a combination of catalytic metals such as platinum, and metal oxides. Catalytic converters are installed in the exhaust systems, for example, the exhaust pipes of automobiles, to convert the toxic gases to nontoxic gases. The use of catalytic converters is thought to be essential in bucking global warming trends and combating other environmental detriments. The catalysts, however, can be poisoned and rendered less effective, if not useless, as a result of exposure to certain elements or compounds, especially phosphorus compounds. Among the many ways phosphorus compounds may be introduced into the exhaust gas is the degradation of phosphorus-containing lubricating oil additives. Examples of phosphorus lubricating oil additives include zinc dialkyldithiophosphates and the like. Zinc dialkyldithiophosphates are among the most effective and conventionally used antioxidants and anti-wear agents, from both a performance and cost-effectiveness standpoint, in lubricating oil compositions. While they are effective antioxidants and antiwear agents, the phosphorus, sulfur and ash they introduce into the engine react with the catalysts and may shorten the service life of the catalytic converters. Reduction catalysts are susceptible to damage by sulfur and sulfur compounds in the exhaust gas, which are introduced by the degradations of both the base oil used to blend the lubricants and sulfur-containing lubricant oil additives. Examples of sulfur-containing lubricant oil additives include, but are not limited to, magnesium sulfonate and other sulfated or sulfonated detergents.

Particulate traps are usually installed in the exhaust system, especially in diesel engines, to prevent the carbon black particles or very fine condensate particles or agglomerates thereof (i.e., "diesel soot") from being released into the environment. Aside from polluting air, water, and other elements of the environment, diesel soot is a recognized carcinogen. These traps, however, can be blocked by metallic ash, which is the degradation product of metal-containing lubricating oil additives including common ash-producing detergent additives.

To insure a long service life for the after-treatment devices, it is desirable to identify lubricating oil additives that exert a minimum negative impact on such, devices. To this end, OEMs often set various limits for maximum sulfur, phosphorus, and/or sulfated ash levels for "new service fill" and "first fill" lubricants. For instance, when used in light-duty passenger-car internal combustion engines, the sulfur levels are typically required to be at or below 0.30 wt. %, the phosphorus levels at or below 0.08 wt. %, and the sulfated ash contents at or below 0.8 wt. %. The maximum sulfur, phosphorus and/or sulfated ash levels may differ, however, when the lubricating compositions are used in heavy-duty Internal combustion engines. For example, the maximum sulfated ash level may be as high as 1.0 wt. % in those heavy-duty engines. Such lubricating oil compositions are also referred to as "low SAPS" (low sulfated ash, phosphorus, sulfur) lubricating oil compositions for gasoline engines and/or light duty diesel engines, and "low SAPS" or "LEDL" (low emission diesel lubricant) oil compositions for heavy duty diesel engines. Various tests have been established and standardized to measure the levels of SAPS in lubricating oil compositions. For example, in Europe, a lubricant meeting the ACEA gasoline and diesel engine low SAPS specification must pass, infer alia, the "CEC L-78-T-99" test, which measures the cleanliness and extent of piston ring sticking after running a Volkswagen turbocharged direct injection automotive diesel engine for an extended time period, cycling alternatively between idle and full power. Similar specification and testing standards of varied stringencies can also be found in other countries and regions, such as Japan, Canada, and the United States.

Meeting the low SAPS environmental standards does not eliminate the need to provide adequate lubricant performance. Automobile spark ignition and diesel engines have valve train systems, including valves, cams and rocker arms, all of which must be lubricated and protected from wear. Further, engine oils must provide sufficient detergency so as to insure engine cleanliness and suppress the production of deposits, which are products of non-combustibles and incomplete combustibles of hydrocarbon fuels and deterioration of engine oils.

As discussed above, the need to preserve the integrity of catalytic converters has led to the use of less phosphate and phosphorus-containing additives. As a result, lubricating oil compositions of low SAPS levels may be more prone to oxidation, especially in the high-temperature environments where automotive engines typically operate. Moreover, the use of detergents, which are typically metal sulfonate detergents, is often inevitable because of the sustained needs to neutralize the oxidation-derived acids and suspend polar oxidation residues in the lubricant, a need that is made all the more prominent when less phosphate and phosphorus-containing additives are present. These detergents, however, contributes to the production of sulfated ash. Indeed, the amount of ash permitted under most of the current environmental standards can be exceeded by far less metal sulfonate detergent than is necessary to achieve adequate detergency performance. Reducing the levels of detergent overbasing may reduce the level of ash produced, but it also reduces the acid neutralizing capacity of the lubricant composition, potentially leading to acid corrosion of the engine pistons and other parts.

Therefore, it would be advantageous to identify low SAPS lubricating oil compositions that not only foster cleaner environment by allowing the catalyst converters and particulate traps to effectively reduce pollutants, but also offer improved thermal stability despite the lower levels of phosphate and phosphorus-containing antioxidants. This will potentially lead to the generation of less oxidation-derived acids and polar oxidation residues, which will in turn require the use of less overbased sulfonate detergents in the lubricants, ultimately resulting in lower sulfated ash levels.

Most if not all finished lubricants used for automobiles, diesel engines, axles, transmissions, and other industrial applications consist of two general components: a lubricating base oil and additives. Lubricating base oil is typically the major constituent in the finished lubricants and contributes significantly to the properties of the finished lubricant. In general, a few lubricating base oils are used to manufacture a wide variety of finished lubricants by varying the mixture of individual lubricating base oils and individual additives. Accordingly, new and improved properties may be instilled in a given lubricating oil composition by varying either or both the base oil and/or the additives.

Certain additives have been identified to offer performance advantages to lubricating oil compositions of low SAPS levels. One of those advantages lies in piston cleanliness. For example, U.S. patent application Ser. No. 11/217,674 (published as U.S. 2006/0052254) disclosed a low SAPS lubricant composition that provided good piston cleanliness in an XUD-IIBTE (CEL-L-56-T-98) test. The lubricating oil composition of this application had a major amount of a base oil, a sulfur content of up to 0.3 wt. %, a phosphorus content of up to 0.08 wt. %, a sulfated ash content of up to 0.80 wt. %, and contained less than 5 mmoles of salicylate soap per kilogram of lubricating oil composition. The base oil of that application was preferably one selected from; base oil blends of Group III base stocks with Group II base stocks; Group III base stocks; and blends of more than one Group III base stock. A companion application, U.S. patent application Ser. No. 11/218,647 (published as U.S. 2006/0058200) disclosed a low SAPS lubricating oil composition with similar advantages. That composition comprised (a) a major amount of a base oil; (b) at least one nitrogen-containing dispersant to provide a nitrogen content of at least 0.075 wt. %, the dispersant having a polyalkenyl backbone of molecular weight of about 900 to about 3000 Daltons; and (c) an oil-soluble or oil-dispersible source of boron to provide a wt. % ratio of nitrogen to boron of about 3:1 to about 5:1; (d) an antioxidant; and (e) a zinc dihydrocarbyl dithiophosphate. The base oil of that application was preferably selected from the same three groups of base stocks as those listed above in the companion application Ser. No. 11/217,674. In U.S. patent application Ser. No. 11/226,793 (published as U.S. 2006/0068999), yet another low SAPS lubricating oil composition comprising (1) a major amount of a base oil, preferably selected from the same three groups of base stocks as in the two applications, Ser. Nos. 11/217,674 and 11/218,647, above; (2) an overbased magnesium-containing lubricating oil detergent having a TBN of 200 to 500 present in such an amount to provide a TBN of 5.3 to 7.3 to the finished composition: and (3) 2.5 to 4 wt. % of an ashless dispersant, was said to provide enhanced piston merits.

Other additives were found to impart an enhanced capacity to retain high total base number (TBN) despite the low SAPS. For example, a low SAPS internal combustion engine oil was reported to retain high TBN in U.S. patent application Ser. No. 11/176,424 (published as U.S. 2006/0014653). The composition had a sulfated ash content of not greater than 0.9 wt. %, and a phosphorus content from 0.04 to 0.1 wt. %. The composition contained base oil, which was not limited to a certain type, and which did not affect the capacity to retain high TBN; one or more detergents selected from phenate detergents, salicylate detergents, and sulphonate detergents, wherein said one or more detergents each, independently, had a TBN value of from 30 to 350 mg KOH/g; and at least 3.5 wt. % of one or more antioxidants selected from the group of amine antioxidants and phenolic antioxidants.

Yet other additives were found to offer improved antiwear properties. U.S. patent application Ser. No. 11/288,600 (published as U.S. 2006/0116300) disclosed a low SAPS lubricant composition that provided improved lubricant performance, and especially antiwear properties, in compression-ignited diesel engines according to a Mack T10 screener test. That lubricant composition comprised (1) a major amount of a base oil, which was not limited to a certain type and did not affect the antiwear capacity; (2) a minor amount of a calcium salicylate detergent; (3) a minor amount of an overbased magnesium detergent; and (4) a minor amount of a basic, low molecular weight nitrogen-containing dispersant derived from a polymer having a number average molecular weight of no greater than 1100 Daltons.

As discussed above, one might also improve a given lubricating oil composition by experimenting with various base oils. It has now been found that at least one FTBOs can be blended with at least one ashless dispersant, at least one metal-containing detergent, at least one anti-wear additive, and at least one antioxidant, into a lubricating oil composition with low SAPS level. That composition demonstrates substantially improved thermal stability from that of a comparative composition comprising the same list of additives but has one or more Group III conventional base oils instead of the FTBOs. The present invention therefore provides a low sulfated ash, low phosphorus and low sulfur lubricant composition comprising a major amount of such one or more FTBOs. The present invention also provides methods of using and making such a lubricating oil composition.

Many lubricating base oils are known in the art. The group designation made by the American Petroleum Institute (API Publication 1509) is one of the most widely used tools to broadly categorize existing base stocks. Accordingly, Group I base stocks generally have a viscosity index of between 80 to 120, contain greater than about 0.03 wt. % sulfur, and/or contain less than about 90% saturates. Group II base stocks generally have a viscosity index of between about 80 to about 120, contain less than or equal to about 0.03 wt. % of sulfur, and/or contain equal to or greater than about 90% saturates. Group III stocks generally have a viscosity index greater than about 120, contain less than or equal to about 0.03 wt. % of sulfur, and/or contain greater than about 90% saturates. Group IV stocks include polyalphaolefins (PAO). Group V base stocks include those not included in Groups I to IV. For low SAPS applications, such as the applications described herein, Group III base stocks are favored because of their low sulfur contents, and of their relative low cost as compared to the expensive PAO-type base oils.

Until recently, the majority of lube base oils used in the world were derived from crude oil. However, persons skilled in the art have recognized several limitations to using crude oil as a source for base oils, such as the limited supply, the inclusion of aromatic compounds that might be harmful and irritating, and the high sulfur- and nitrogen-contents that could adversely affect the environment. Such limitations have motivated a search for alternative sources from which lube base stocks may be derived. One of such sources is natural gas. Preparing lube base oils from natural gas involves converting the natural gas, which is mostly methane, to synthesis gas, or "syngas," which is a mixture of carbon monoxide and hydrogen. Advantageously, products prepared from syngas do not contain nitrogen or sulfur and generally do not contain aromatic compounds. Accordingly, they have minimal health and environmental impact.

Fischer-Tropsch chemistry has been used to convert the syngas to a product stream that Includes, among others, lube base oils. Advantageously, the Fischer-Tropsch products in that stream typically contain little, if any, petroleum contaminants, such as aromatic compounds, sulfur compounds, and nitrogen compounds. These products are thus considered environmentally friendly. Despite such advantages, lube base oils converted from syngas did not find widespread use in the industry, at least in the dozens of years after the initial discovery and development of the method. Various problems limited their use. For example, due to their high paraffin content, FTBOs may exhibit poor additive solubility. Moreover, the Fischer-Tropsch process typically produces a syngas mixture containing a wide range of products, only a small portion of which have molecular weights and/or viscosities that are sufficiently high. Specifically, only a small portion of the Fischer-Tropsch products have viscosities have at or above about 3 cSt at 100° C., which is typically required for use flit lube base stocks. The rest of the Fischer-Tropsch products having viscosities below 3 cSt at 100° C. have limited use as lube base oils. They are typically cracked into lower molecular weight materials, such as diesel and naphtha, which have substantially lower market values than do lubricating base oils.

Solutions have been developed to counter these problems. For example, to address the problem of poor additive solubility, various co-solvents such as synthetic esters were used. Alternatively, to limit the amount of expensive synthetic ester co-solvents that must be used to dissolve additives, a highly paraffinie FTBO may be mixed with at least one lube base stock composed of alkylaromatics, alkylcycloparaffins, or mixtures thereof, having a viscosity of greater than 2 cSt at 40° C. This alternative approach was described in U.S. Pat. No. 6,833,065. Moreover, U.S. Pat. No. 6,562,230 described an approach that converted the other, less useful fractions of the Fischer-Tropsch products into fractions suitable for use in preparing lube base oils. Recently, U.S. patent application Ser. No. 10/561,945 (published as US 2006/0157384 A1), disclosed a process comprising (1) separating the Fischer-Tropsch synthesis product into three fractions: (a) one that boils in the middle distillate range and below, (b) a heavy ends fraction, and (c) an Intermediate base oil precursor fraction that boils between fraction (a) and (b); and (2) directly subjecting the intermediate fraction (c) and a high boiling fraction obtained from subjecting the heavy ends fraction (b) to a conversion step prior to the selective isomerization and dewaxing steps. That process was said to provide a higher-than-usual proportion of suitable, base stocks. Solutions such as these have made and/or will continue to make base oils derived from the Fischer-Tropsch process more attractive to those skilled in the art.

The present invention provides a low sulfated ash, low phosphorus and low sulfur lubricant composition comprising a major amount of one or more FTBOs. The lubricant composition offers favorable thermal stability without added phosphate- and/or phosphorus-containing antioxidants, or added sulfated-ash-producing detergents. The present invention further provides methods of applying and making these compositions.

SUMMARY OF THE INVENTION

The present invention provides lubricating oil compositions that provide high thermal stability, especially when the automotive engines housing those compositions operate at elevated temperatures, but which introduce low levels of phosphorous, low levels of sulfur, and low levels of sulfated ash to the engines and the environment. The levels of phosphorous in the lubricating oil compositions of the present invention are typically at or below about 0.09 wt. %, and preferably at or below about 0.08 wt. %, and more preferably at or below about 0.07 wt. %, and particularly preferably at or below about 0.05 wt. %. The levels of sulfur produced by the lubricating oil compositions of the present invention are typically at or below about 0.30 wt. %, and preferably at or below about 0.20 wt. %, and particularly preferably at or below about 0.10 wt. %. The levels of sulfated ash produced by the lubricating oil compositions of the present invention are typically at or below about 1.60 wt. %, but preferably at or below about 1.00 wt. %, more preferably at or below about 0.80 wt. %, even more preferably at or below about 0.50 wt. %, and particularly preferably at or below about 0.45 wt. %. In one embodiment of the present invention, the level of sulfated ash will be from above about 0.50 to about 1.60 wt. %, preferably from above about 0.5 to about 0.8 wt. %.

Therefore, the present lubricating compositions are more desirable from an environmental standpoint than the conventional engine lubricating oils that contain higher phosphorous, sulfur and sulfated ash. The present compositions facilitate longer service lives for the catalytic converters and the particulate traps, while providing the desired thermal stability.

In a first aspect, the present lubricating oil composition comprises:

a major amount of one or more FTBOs;
one or more detergents;
one or more dispersants;
one or more anti-wear additives; and
one or more antioxidants, wherein, based on the total weight of the lubricating composition, the phosphorus content is at or below about 0.09 wt. %; the sulfur content is at or below about 0.3 wt. %; and the sulfated ash content is at or below about 1.6 wt. %.

A lubricating oil composition of this aspect may optionally further comprise one or more additives selected from: (1) friction modifiers; (2) corrosion inhibitors; (3) anti-foam additives; (4) seal fixes or seal pacifiers; (5) viscosity index improvers; (6) pour point depressants; and (7) multifunctional additives.

A lubricating oil composition of this aspect may optionally comprise one or more other base oils, so long as they do not negatively affect the thermal stability of the composition. By "negatively affect," it is meant that the thermal stability of the composition is to any extent reduced, as measured by art-accepted engine or bench tests indicating such stability and designed to mimic the conditions under which the engines operate.

In a second aspect, the invention provides a method of operating an automotive engine provided with one or more exhaust gas after-treatment devices, which method comprises lubricating said engine with a lubricating composition of the first aspect.

In a third aspect, the invention provides a method of preparing a lubricating oil composition of the first aspect.

Persons skilled in the art will understand other and further objects, advantages, and features of the present invention by reference to the following description.

DETAILED DESCRIPTION OF THE INVENTION

Various preferred features and embodiments are described below by way of non-limiting illustrations.

The present invention provides lubricating oil compositions as described above. The compositions have a total sulfur content of at or below about 0.30 wt. % in typical embodiments, at or below about 0.20 wt. % in some other embodiments, and at or below about 0.10 wt. % in further embodiments. An exemplary lubricant composition of the present invention contains about 0.2 wt. % of sulfur, based on the total weight of the composition.

The lubricating oil compositions have a total phosphorus content of at or below about 0.09 wt. % in typical embodiments, at or below about 0.08 wt. % in some other embodiments, at Or below about 0.07 wt. % in yet other embodiments, and at or below about 0.05 wt. % in further embodiments. An exemplary lubricant composition of the present invention contains about 0.07 wt. % of phosphorus, based on the total weight of the composition.

The lubricating oil compositions have a total sulfated ash content of, as determined by the ASTM D-874, at or below about 1.60 wt. % in typical embodiments, at or below about 1.00 wt. % in some other embodiments, at or below about 0.80 wt. % in yet other embodiments, at or below about 0.50 wt. % in some of her embodiments, and at or below about 0.45 wt. % in further embodiments. An exemplary lubricant composition of the present invention has a sulfated ash content of about 0.8 wt. %, based on the total weight of the lubricant compositions.

Oil of Lubricating Viscosity

1. FTBOs

The low-SAPS lubricating oil composition of the present invention comprises one or more base oils, at least one of which is a FTBO. The one or more base oils are present in a major amount (i.e., an amount greater than about 50 wt. %). Generally, the total amount of base oil is greater than about 60 wt. %, or greater than about 70 wt. %, or greater than about 8.0 wt. % of the lubricating oil composition. An exemplary lubricating oil composition of the present invention comprises about 78 wt. % of a base stock comprising two FTBOs. The base oil sulfur content is less than about 0.60 wt. %, preferably less than about 0.30 wt. %, more preferably less than about 0.10 wt. %.

At least one of the one or more base oils used in the engine lubricating oil compositions of the present invention is a FTBO. As described above, FTBOs are derived originally from natural gas via a Fischer-Tropsch chemical process. Suitable FTBOs typically have a kinematic viscosity of at least 2 cSt at 100° C., preferably at or above 3 cSt 100° C. As it is understood by persons skilled in the art, kinematic viscosity is the ratio of viscosity to density. Direct measurements of kinematic viscosity are typically taken by various viscometers, such as, for example, a simple glass capillary viscometer. A blend of two or more FTBOs with different kinematic viscosity may also be used. An exemplary base stock of the present invention comprises two FTBOs, the first having a kinematic viscosity of about 4.1 cSt at 100° C., and the second having a kinematic viscosity of about 7.9 cSt at 100° C. Moreover, suitable FTBOs typically have a viscosity index of greater than about 100. An exemplary base stock of the present invention comprises two FTBOs, the first having a viscosity index of about 146, and the second having a viscosity index of about 161.

If two or more FTBOs are blended into one base stock, the amounts of the FTBOs can be in any proportion so that the base stock has the desired kinematic viscosity, viscosity index, pour point, cloud point, sulfur content, saturates content, and alkyl branching level, as described herein. When two FTBOs are blended into one base stock, for example, that proportion may be from 10:90 to 90:10, or from 20:80 to 80:20, such as from 30:70 to 70:30. An exemplary base stock of the present invention comprises two FTBOs blended in a proportion of about 37:63.

Suitable FTBOs typically also have a pour point below 20° C., preferably below about −8° C. or below about −2° C., such as below about −15° C. As it is understood by persons skilled in the art, pour point is the temperature at which a sample of the lubricant base oil will begin to flow under carefully controlled conditions. The pour point of a given oil can be determined by standard analytical methods, such as, for example, the ASTM D 5930-02. An exemplary base stock of the present invention comprised two FTBOs, the first having a pour point of about −20° C., and the second having a pour point of about −14° C.

Suitable FTBOs typically also have a cloud point of less than about 2° C. Cloud point measures the temperature at which a sample of the base oil begins to develop a haze under carefully specified conditions. Cloud points can be determined by for example, the ASTM D 5773-95. An exemplary base stock of the present invention comprised two FTBOs, the first having a cloud point of about −11° C., and the second having a cloud point of about 2° C.

Suitable FTBOs according to the present invention generally have a saturates content of greater than about 90%, and total naphthene content of about 0 to about 10%, preferably about 0 to about 7%. Generally, if naphthenes are present, they are preferably mononaphthenes. The amount of naphthenes are measured using methods known in the art such as, for example, the Field Ionization Mass Spectroscopy ("FIMS") described in "Influence of Group II & III Base Oil Composition on VI and Oxidation Stability," presented by Kramer, D. C., et al at the 1999 AIChE Spring National Meeting in Houston on Mar. 16, 1999. Suitable FTBOs comprise paraffinic hydrocarbon components having less than 12 alkyl branches per 100 carbons, and preferably less than 10 alkyl branches per 100 carbons. An exemplary base stock of the present invention comprises two FTBOs, the first having about 9.46 alkyl branches per 100 carbons, and the second having about 8.17 alkyl branches per 100 carbons.

Because of the very low amounts of aromatics and multi-ring naphthenes in the FTBOs, they have superior oxidation stability. One art-accepted way to measure the oxidation stability of lubricating base oils is the Oxidator BN test, as described in U.S. Pat. No. 3,852,207, the disclosures of which, to the extent they are relevant to the Oxidator BN test, and to the extent they do not conflict with the disclosures and claims herein, are incorporated by reference. Specifically, the Oxidator BN test measures the resistance to oxidation by means of a Dornte-type oxygen absorption apparatus, as descried by R. W. Dornte in "Oxidation of White Oils," Industrial and Engineering Chemistry, Vol. 28, page 26 (1936). Normally, the conditions are one atmosphere of pure oxygen at 340° F. The results are reported in hours to absorb 1000 ml of $O_2$ by 100 g of oil. In the Oxidator BN test, 0.8 ml of catalyst is used per 100 grams of oil, and an additive package Is included in the oil. The catalyst is a mixture of soluble metal-naphthenates in kerosene simulating the average metal analysis of used crankcase oil. The concentrations of the metals in the catalyst are: 6,927 ppm copper; 4,083 ppm iron; 80,208 ppm lead; 350 ppm manganese; and 3565 ppm tin. The additive package comprises 80 mmole of zinc bispolypropylenephenyl dithiophosphate per 100 grams of oil. Oxidator BN measures the response of a base oil in a simulated application. High values, or long times to absorb one liter of oxygen, indicate good oxidation stability. For general use, it is desired that the Oxidator BN of a lubricant base oil be above 7 hours. An exemplary FTBO of the present invention has an Oxidator BN of about 37.32 hours.

Suitable FTBOs can be prepared by methods known in the art, many of which comprise some kind of hydroisomerization of the Fischer-Tropsch synthesis product followed by a dewaxing step of the higher boiling fraction. Specifically, the Fischer-Tropsch synthesis product can be obtained by well-known processes such as, or example, the commercial SASOL® process, the commercial SHELL® Middle. Distillate Process, or by the non-commercial Exxon® process. Details of these processes and others are described in more details in, for example, EP-A-776959, EP-A-668342, U.S. Pat. Nos. 4,943,672 and 5,059,299, WO-A-9934917 and WO-A-9920720. Typically the Fischer-Tropsch synthesis product comprises hydrocarbons having 1 to 100, or even more than 100 carbon atoms. The hydrocarbon products further comprise iso-paraffins, n-paraffins, oxygenated products, and unsaturated products.

The Fischer-Tropsch synthesis product is typically separated into three fractions: (1) a fraction that boils in the middle distillate range and below; (2) a heavy ends fraction, and (3) an intermediate base oil precursor range. Fractionation may be performed by known methods such as flashing or distillation. The products in ail three fractions may be further hydrogenated in order to remove any oxygenates or unsaturated materials. The intermediate base oil precursor fraction boils predominately between 200 and 350° C., and it typically comprises the gas oil and kerosene fractions, which can be removed from the rest of the Fischer-Tropsch synthesis product. This fraction is then subjected to a catalytic hydroisomerization process followed by a catalytic dewaxing process to yield one or more base oil grades.

The catalytic hydroisomerization and catalytic dewaxing may be performed with one catalyst or by separate dedicated isomerization and dewaxing catalysts. Suitable isomerization catalysts typically comprise one or more group VIII metals such as, for example, nickel, cobalt, platinum, or palladium, on a refractory oxide carrier. Examples of these catalysts include Pt on silica-alumina carrier (ASA), Pd on ASA, PtNi on ASA, PtCo on ASA, PtPd on ASA, CoMoCu on ASA, NiMoCu on ASA, NiW on ASA, NiWF on alumina, PtF on ASA, and NiMoF on alumina. A suitable dewaxing catalyst may comprise medium pore size molecular sieves and a hydrogenation component, preferably a noble metal such as platinum or palladium. Examples of such catalysts include those based on SAPO-11, as described in EP-A-458895; those based on ZSM-5, as described in EP-B-832171; those based on ZSM-23, as described in EP-A-540590 and EP-A-092376; those based on ZSM-22, as described in U.S. Pat. No. 4,574,043; those based on mordenite, as described in U.S. Pat. No. 6,179,994; and those based on ferrierite, as described in EP-A-1029029. Suitable catalysts that can be used in both the hydroisomerization step and the dewaxing step include, for example, those based on platinum-zeolite beta, as described In U.S. Pat. No. 5,885,438; and those based on ZSM-23 or ZSM-22, as described in EP-A-536325.

Following the dewaxing step, the desired base oils are preferably isolated from the dewaxed effluent in a base oil recovery step. In this step, lower boiling compound formed during catalytic dewaxing are removed, typically by means of distillation, optionally in combination with an initial flashing step.

2. Non-FTBO Base Oils

The lubricating oil composition of the present invention may or may not include other base oils in addition to the one or more FTBOs. If one or more additional base oils are included, they may be selected front: natural oils, synthetic oils, and mixtures thereof, provided that the sulfur content of such an oil does not exceed the above-indicated sulfur concentration limit required to sustain the low SAPS lubricating oil compositions. Moreover, if one or more additional base oils (i.e., other than the FTBO) are present, these additional base oils do not negatively affect the improvement in thermal stability that is provided for by the one or more FTBOs. The natural oils that are suitable include animal oils and vegetable oils (e.g., castor oil, lard oil). The natural oils may also include mineral lubricating oils such as liquid petroleum oils and solvent-treated or acid-treated mineral lubricating oils of the paraffinic, naphthenic or mixed paraffinic-naphthenic types. Oils derived from coal or shale are also useful.

Synthetic and non-FTBO lubricating oils include hydrocarbon oils such as polymerized and inter-polymerized olefins (e.g., polybutylenes, polypropylenes, propylene isobutylene copolymers, etc.); poly(1-hexenes), poly-(1-octenes), poly(1-decenes), etc. and mixtures thereof; alkylbenzenes (e.g., dodecylbenzenes, tetradecylbenzenes, dinonylbenzenes, di-(2-ethylhexyl)benzenes, etc.); polyphenyls (e.g., biphenyls, terphenyls, alkylated polyphenyls, etc.); alkylated diphenyl ethers and the derivatives, analogs and homologs thereof, and the like. Oils prepared by a known Fischer-Tropsch gas-to-liquid synthetic procedure are described above, and are the preferred base oils in the present invention.

Another class of known synthetic lubricating oils includes alkylene oxide-polymers and interpolymers and derivatives thereof where the terminal hydroxyl groups have been modified by a process such as esterification or etherification. Examples of these synthetic oils include polyoxyalkylene polymers prepared by polymerization of ethylene oxide or propylene oxide, and the alkyl and aryl ethers of polyoxyalkylene polymers (e.g., methyl-polyiso-propylene glycol ether having a molecular weight of 1000 Daltons or diphenyl ether of poly-ethylene glycol having a molecular weight of 1000 to 1500 Daltons); and mono- and polycarboxylic esters thereof (e.g., acetic acid esters, mixed $C_3$-$C_8$ fatty acid esters, and $C_{13}$ Oxo acid diester of tetraethylene glycol).

Another suitable class of synthetic lubricating oils are the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dirtier, malonic acid, alkylmalonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Specific examples of such esters includes dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, die 2-ethylhexyl diester of linoleic acid, dimer, and the complex ester formed by reacting one mole of sebacic acid with two moles of tetraethylene glycol and two moles of 2-ethylhexanoic acid and the like.

Esters useful as synthetic oils also include those made from $C_5$ to $C_2$ monocarboxylic acids and polyols and polyol esters such as neopentyl glycol, trimethylolpropane, pentaerythritol, dipentaerythritol and tripentaerythritol. Esters are sometimes also useful as additives to improve certain other properties of a finished lubricant. In an exemplary lubricating oil of the present invention, a minor amount of a polyolester, NP 343 (ESTEREX™ by ExxonMobile) was added to improve the low temperature properties of the finished oil.

The synthetic oil can also be a poly-alpha-olefin (PAO). Typically, the PAOs are derived from monomers having from 4 to 30, or from 4 to 20, or from 6 to 16 carbon atoms. Examples of useful PAOs include those derived from octene, decene, mixtures thereof and the like. These PAOs may have a viscosity from about 2 to about 5, or from about 3 to about 12, or from about 4 to about 8 $mm^2/s$ (cSt) at 100° C. Mixtures of mineral oil with one or more of the foregoing PAOs may be used.

Unrefined, refined and rerefined ails, either natural or synthetic (as well as mixtures of two or more) of the types of oils disclosed above can be used in the lubricating compositions of the present invention. Unrefined (or raw) oils are those obtained directly from a natural or synthetic source without further purification treatment. Refined oils are similar-to the unrefined oils except they have been further treated in one or more purification steps. Many such purification techniques are known to those skilled in the art such as solvent extraction, secondary distillation, acid or base extraction, filtration, percolation, and the like. Rerefined oils are oils that have been used in service but are subsequently treated so that they may be re-applied in service. Because the used oils almost always contain spent additives and breakdown products, in addition to the standard oil refining steps, steps that would remove the spent additives and breakdown products must be taken. Such rerefined oils are also known as reclaimed or reprocessed oils.

Various mid- to top-tier low grade engine oils, including, for example, 0W-30, 5W-30, 0W-40, and 5W-40 oils, may be formulated from the lubricating base oils of the present invention. These engine oils have improved thermal stability as compared to an oil of the same grade comprising one or more hydro-cracked Group III base oils without any FTBO.

Metal-Containing Detergents

Metal-containing or ash-forming detergents function both as detergents to reduce or remove deposits and as acid neutralizers or rust inhibitors, thereby reducing wear and corrosion and extending engine life. Detergents generally comprise a polar head with long hydrophobic tail, with the polar head comprising a metal salt of an acid organic compound. The composition of the present invention may contain one or more detergents, which are normally salts, and especially overbased salts. Overbased salts, or overbased materials, are single phase, homogeneous Newtonian systems characterized by a metal content in excess of that which would be present according to the stoichiometry of the metal and the particular acidic organic compound reacted with the metal. The overbased materials are prepared by reacting an acidic material (typically an inorganic acid or lower carboxylic acid, preferably carbon dioxide) with a mixture comprising an acidic organic compound, in a reaction medium comprising at least one inert, organic solvent (such as mineral oil, naphtha, toluene, xylene) in the presence of a stoichiometric excess of a metal base and a promoter.

The acidic organic compounds useful in making the overbased compositions of the present invention include carboxylic acids, sulfonic acids, phosphorus-containing acids, phenols or mixtures thereof. Preferably, the acidic organic compounds are carboxylic acids or sulfonic acids with sulfonic or thiosulfonic groups (such as hydrocarbyl-substituted benzenesulfonic acids), and hydrocarbyl-substituted salicylic acids.

Carboxylate detergents, e.g., salicylates, can be prepared by reacting an aromatic carboxylic acid with an appropriate metal compound such as an oxide or hydroxide. Neutral or overbased products may then be obtained by methods well known in the art. The aromatic moiety of the aromatic carboxylic acid can contain heteroatoms, such as nitrogen and oxygen. Preferably, the moiety contains only carbon atoms. More preferably, the moiety contains six or more carbon atoms, such as a benzene moiety. The aromatic carboxylic acid may contain one or more aromatic moieties, such as one or more benzene rings, fused or otherwise connected via alkylene bridges. Examples of aromatic carboxylic acids include salicylic acids and sulfurized derivatives thereof such as hydrocarbyl substituted salicylic acid and derivatives thereof. Processes for sulfurizing, for example a hydrocarbyl-substituted salicylic acid, are known to those skilled in the art. Salicylic acids are typically prepared by carboxylation, for example, by the Kolbe-Schmitt process, of phenoxides. In that case, salicylic acids are generally obtained in a diluent in admixture with uncarboxylated phenol.

Sulfonates can be prepared by using sulfonic acid in to sulfoniate alkyl-substituted aromatic hydrocarbons such as those obtained from the fractionation of petroleum or those obtained from alkylation of aromatic hydrocarbons. Alkaryl sulfonates usually contain from about 9 to about 80 or more carbon atoms, preferably from about 16 to about 60 carbon atoms per alkyl substituted aromatic moiety.

Metal salts of phenols and sulfurized phenols are prepared by reaction with an appropriate metal compound such as an oxide or hydroxide. Neutral or overbased products may be obtained by methods well known in the art. For example, sulfurized phenols may be prepared by reacting a phenol with sulfur or a sulfur-containing compound such as hydrogen sulfide, sulfur monohalide or sulfur dihalide, to form products that are mixtures of compounds in which 2 or more phenols are bridged by sulfur-containing bridges.

The metal compounds useful in making the overbased salts are generally any Group I or Group II metal compounds in the Periodic Table of the Elements. The Group I metals of the metal compound include Group Ia alkali metals (e.g., sodium, potassium, lithium) as well as Group Ib metals such as copper. The Group I metals are preferably sodium, potassium, lithium and copper, more preferably sodium or potassium, and particularly preferably sodium. The Group II metals of the metal base include the Group IIa alkaline earth metals (e.g., magnesium, calcium, strontium, barium) as well as the Group IIb metals such as zinc or cadmium. Preferably the Group II metals are magnesium, calcium, barium, or zinc, more preferably magnesium or calcium, particularly preferably calcium.

Examples of the overbased detergents include, but are not limited to calcium sulfonates, calcium phenates, calcium salicylates, calcium stearates and mixtures thereof. Overbased detergents suitable for use with the lubricating oils of the present invention may be low overbased (i.e., Total Base Number (TBN) below about 100). The TBN of such a low-overbased detergent may be from about 5 to about 50, or from about 10 to about 30, or from about 15 to about 20. The overbased detergents suitable for use with the lubricating oils of the present invention may alternatively be high overbased (i.e., TBN above about 100). The TBN of such a high-overbased detergent may be from about 150 to about 450, or from about 200 to about 350, or from about 250 to about 280. A low-overbased calcium sulfonate detergent with a TBN of about 17 and a high-overbased sulfurized calcium phenate with a TBN of about 260 are two exemplary overbased detergents in the lubricating oil compositions of the present invention. The lubricating oil compositions of the present invention may comprise more than one overbased detergents, which may be all low-TBN detergents, all high-TBN detergents, or a mix of those two types.

In the lubricant oil compositions of the present invention, the amount of the overbased detergent(s), if present, may be about 0.05 to about 16 mM, or about 3 to about 15 mM, or about 4 to about 14 mM. In an exemplary embodiment of the present invention, about 4 mM of a low-TBN detergent plus about 10 mM of a high-TBN detergent are present in the lubricating oil composition.

Suitable detergents for the lubricating oil compositions of the present invention also include "hybrid" detergents such as, for example, phenate/salicylates, sulfonate/phenates, sulfonate/salicylates, sulfonates/phenates/salicylates, and the like. Hybrid detergents have been described, for example, in U.S. Pat. Nos. 6,153,565, 6,281,179, 6,429,178, and 6,429,179. Relevant disclosures of these patent applications and patents, to the extent they do not conflict with the disclosures and claims herein, are incorporated by reference.

Ashless Dispersants

Dispersants are generally used to maintain in suspension insoluble materials resulting from oxidation during use, thus preventing sludge flocculation and precipitation or deposition on metal parts. Nitrogen-containing ashless (metal-free) dispersants are basic, and contribute to the TBN of a lubricating oil composition to which they are added, without introducing additional sulfated ash. An ashless dispersant generally comprises an oil soluble polymeric hydrocarbon backbone having functional groups that are capable of associating with particles to be dispersed. Many types of ashless dispersants are known in the art.

Typical dispersants include, but are not limited to, amines, alcohols, amides, or ester polar moieties attached to the polymer backbones via bridging groups. The ashless dispersant of the present invention may be, for example, selected from oil soluble salts, esters, amino-esters, amides, imides, and oxazolines of long chain hydrocarbon substituted mono and dicarboxylic acids or their anhydrides; thiocarboxylate derivatives of long chain hydrocarbons, long chain aliphatic hydrocarbons having a polyamine attached directly thereto; and Mannich condensation products formed by condensing a long chain substituted phenol with formaldehyde and polyalkylene polyamine.

"Carboxylic dispersants" are reaction products of carboxylic acylating agents (acids, anhydrides, esters, etc.) comprising at least 34 and preferably at least 54 carbon atoms with nitrogen containing compounds (such as amines), organic hydroxy compounds (such as aliphatic compounds including monohydric and polyhydric alcohols, or aromatic compounds including phenols and naphthols), and/or basic inorganic materials. These reaction products include imides, amides, and esters.

Succinimide dispersants are a type of carboxylic dispersants. They are produced by reacting hydrocarbyl-substituted succinic acylating agent with organic hydroxy compounds, or with amines comprising at least one hydrogen atom attached to a nitrogen atom, or with a mixture of the hydroxy compounds and amines. The term "succinic acylating agent" refers to a hydrocarbon-substituted succinic acid or a succinic acid-producing compound, the latter encompasses the acid itself. Such materials typically include hydrocarbyl-substituted succinic acids, anhydrides, esters (including half esters) and halides.

Succinic-based dispersants have a wide variety of chemical structures, which may be represented by the formula:

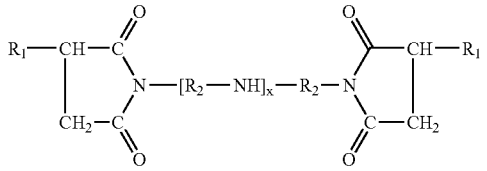

wherein each $R_1$ is independently a hydrocarbyl group, such as a polyolefin-derived group. Typically the hydrocarbyl group is an alkyl group, such as a polyisobutyl group. Alternatively expressed, the $R_1$ groups can contain about 40 to about 500 carbon atoms, and these atoms may be present in aliphatic forms. $R_2$ is an alkylene group, commonly an ethylene ($C_2H_4$) group. Succinimide dispersants have been more fully described in, for example, U.S. Pat. Nos. 4,234,435, 3,172,892 and 6,165,235. Relevant disclosures of these patents, to the extend they do not conflict with the disclosures herein, are incorporated by reference.

The polyalkenes from which the substituent groups are derived are typically homopolymers and interpolymers of polymerizable olefin monomers of 2 to 16 carbon atoms, and usually 2 to 6 carbon atoms. The amines which are reacted with the succinic acylating agents to form the carboxylic dispersant composition can be monoamines or polyamines.

Succinimide dispersants are referred to as such since they normally contains nitrogen largely in the form of imide functionality, although the amide, functionality may be in the form of amine salts, amides, imidazolines as well as mixtures thereof. To prepare a succinimide dispersant, one or more succinic acid-producing compounds and one or more amines are heated and typically water is removed, optionally in the presence of a normally liquid and substantially inert organic liquid solvent/diluent. The reaction temperature is generally in the range of about 80° C. up to the decomposition temperature of the mixture or the product, which typically falls between about 100° C. and about 300° C. Additional details and examples of the procedures for preparing the succinimide dispersants of the present invention have been described in, for example, U.S. Pat. Nos. 3,172,892, 3,219,666, 3,272,746, 4,234,435, 6,440,905 and 6,165,235. Relevant disclosures of these patents, to the extend they do not conflict with the disclosures herein, are incorporated by reference.

Suitable ashless dispersants may also include amine dispersants, which are reaction products of relatively high molecular weight aliphatic halides and amines, preferably polyalkylene polyamines. Examples thereof have been described, for example, in U.S. Pat. Nos. 3,275,554, 3,438,757, 3,454,555, 3,565,804, and the like. Relevant disclosures of these patents, to the extend they do not conflict with the disclosures herein, are also incorporated by reference.

Suitable ashless dispersants may further include "Mannich dispersants," which are reaction products of alkyl phenols in which the alkyl group contains at least 30 carbon atoms with aldehydes (especially formaldehyde) and amines (especially polyalkylene polyamines). These dispersants have been described, for example, in U.S. Pat. Nos. 3,036,003, 3,586,629, 3,591,598, 3,980,569, and the like. Relevant disclosures of these patents, to the extent they do not conflict with the disclosures and claims herein, are likewise incorporated by reference.

Suitable ashless dispersants may even include post-treated dispersants, which are obtained by reacting carboxylic, amine or Mannich dispersants with reagents such as dimercaptothiazoles, urea, thiourea, carbon disulfide, aldehydes, ketones, carboxylic acids, hydrocarbon-substituted succinic anhydrides, nitrile epoxides, boron compounds and the like. Post-treated dispersants have been described, for example, in U.S. Pat. Nos. 3,329,658, 3,449,250, 3,666,730, and the like. Relevant disclosures of these patents, to the extent they do not conflict with the disclosures and claims herein, are further incorporated by reference.

Suitable ashless dispersants may be polymeric, which are interpolymers of oil-solubilizing monomers such as decyl methacrylate, vinyl decyl ether and high molecular weight olefins with monomers containing polar substitutes. Polymeric dispersants have been described, for example, in U.S. Pat. Nos. 3,329,658, 3,449,250, 3,666,730, and the like. Relevant disclosures of these patents, to the extent they do not conflict with the disclosures and claims herein, are similarly incorporated by reference.

In an exemplary lubricating oil composition of the present invention, an ethylene, carbonate-treated bissuccinimide derived from a polyisobutylene having a number average molecular weight of about 2300 was used as the ashless dispersant. The dispersant(s) of the present invention are preferably non-polymeric (e.g., are mono- or bissuccinimides).

The ashless dispersant is suitably present in an amount of about 0.5 to about 10.0 wt. %, preferably about 3.0 to about 7.0 wt. %. An exemplary lubricating oil composition of the present Invention comprises an ethylene-carbonate treated bissuccinimide dispersant derived from a polyisobutylene succinic anhydride, wherein the polyisobutylene chain has a number average molecular weight of about 2300 Daltons ("PIBSA 2300"), in an amount of about 6.5 wt. %. Preferably, the lubricating oil composition comprises from about 0.01 to about 0.35 wt. %, preferably from about 0.05 to about 0.25 wt. %, particularly preferably from about 0.08 to about 0.12 wt. % of total nitrogen from dispersant.

Antiwear Additives

Dihydrocarbyl dithiophosphate metal salts are frequently used as antiwear and antioxidant agents. The metal may be an alkali or alkaline earth metal, or aluminum, lead, tin, molybdenum, manganese, nickel or copper. The zinc salts are the most commonly used in lubricating oil in amounts of about 0.1 to about 10 wt. %, preferably about 0.2 to about 2 wt. %, based upon the total weight of the lubricating oil composition. They may be prepared in accordance with known techniques by first forming a dihydrocarbyl dithiophosphoric acid (DDPA), usually by reaction of one or more alcohol or a phenol with $P_2S_5$ and then neutralizing the formed DDPA with a zinc compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the zinc salt, any basic or neutral zinc compound could be used but the oxides, hydroxides and carbonates are most often employed. Commercial additives frequently contain an excess of zinc due to the use of an excess of the basic zinc compound in the neutralization reaction.

The preferred oil-soluble zinc dialkyldithiophosphates may be produced from dialkyldithiophosphoric acids of the formula:

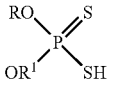

The hydroxyl alkyl compounds from which the dialkyldithiophosphoric acids are derived can be represented generically by the formula ROH or R'OH, wherein R or R' is alkyl or substituted alkyl, preferably branched or non-branched alkyl containing 3 to 30 carbon atoms. More preferably, R or R' is a branched or non-branched alkyl containing 3 to 8 carbon atoms.

Mixtures of hydroxyl alkyl compounds may also be used. These hydroxyl alkyl compounds need not be monohydroxy alkyl compounds. The dialkyldithiophosphoric acids may thus be prepared from mono-, di-, tri-, tetra-, and other polyhydroxy alkyl compounds, or mixtures of two or more of the foregoing. Preferably, the zinc dialkyldithiophosphate derived from only primary alkyl alcohols is derived from a single primary alcohol. Preferably, that single primary alcohol is 2-ethylhexanol Preferably, the zinc dialkyldithiophosphate derived from only secondary alkyl alcohols. Preferably, that mixture of secondary alcohols Is a mixture of 2-butanol and 4-methyl-2-pentanol.

The phosphorus pentasulfide reactant used in the dialkyldithiophosphoric acid formation step may contain minor amounts of any one or more of $P_2S_3$, $P_4S_7$, $P_4S_9$. Compositions as such may also contain minor amounts of free sulfur.

Although the lubricating oil compositions of the present invention are capable of providing excellent antiwear performance in the presence of amounts of zinc dialkyldithiophosphate providing greater amounts of phosphorus, the improved performance of the inventive lubricating oil compositions are particular apparent in low SAPS formulations which, by definition, have phosphorus levels of no greater than about 0.08 wt. %. Therefore, lubricating oil compositions of the present invention contains less than about 0.08 wt. % of phosphorus, more preferably from about 0.03 to about 0.075 wt. % of phosphorus. An exemplary lubricating oil composition of the present invention comprises about 11.5 mM zinc dialkyldithiophosphate.

Antioxidants

Oxidation inhibitors or antioxidants reduce the tendency of mineral oils to deteriorate in service. Such oxidation inhibitors include hindered phenols, alkaline earth metal salts of alkylphenolthioesters having preferably $C_5$ to $C_{12}$ alkyl side chains, calcium nonylphenol sulfide, oil soluble phenates and sulfurized phenates, phosphosulfurized or sulfurized hydrocarbons or esters, phosphorous esters, metal thiocarbamates, oil soluble copper compounds as described in, for example, U.S. Pat. No. 4,867,890.

Aromatic amines having at least two aromatic groups attached directly to the nitrogen constitute another class of compounds that is frequently used for antioxidancy. Typical oil soluble aromatic amines having at least two aromatic groups attached directly to one amine nitrogen contain from 6 to 16 carbon atoms. The amines may contain more than two aromatic groups. The aromatic rings are often substituted by one or more substituents selected from, for example, alkyl, cycloalkyl, alkoxy, aryloxy, acyl, acylamino, hydroxy, and nitro groups.

Lubricating oil compositions in accordance with the present invention preferably contain from about 0.05 to about 5.00 wt. %, more preferably from about 0.10 to about 3.00 wt.

%, and particularly preferably from about 0.20 to about 0.80 wt. % of phenolic antioxidant, aminic antioxidant, or a combination thereof, based on the total weight of the lubricating oil composition. An exemplary lubricating oil composition of the present invention comprises about 0.40 wt. % of an antioxidant that is di-$C_8$-diphenylamine.

Other Additives

The lubricating oil compositions of the present invention may optionally comprise various other additives, including, but not limited to, friction modifiers, antioxidants, corrosion inhibitors, viscosity index improvers, and other additives commonly used to lubricate automotive engines.

1. Viscosity Index Modifiers

The viscosity index of the base stock is increased, or improved, by incorporating therein certain polymeric materials that function as viscosity modifiers (VM) or viscosity index improvers (VII). Generally, polymeric materials useful as viscosity modifiers are those having number average molecular weights (Mn) of from about 5,000 to about 250,000, preferably from about 15,000 to about 200,000, more preferably from about 20,000 to 150,000 Daltons. These viscosity modifiers can optionally be grafted with grafting materials such as, for example, maleic anhydride, and the grafted material can be reacted with, for example, amines, amides, nitrogen-containing heterocyclic compounds or alcohol, to form multifunctional viscosity modifiers (dispersant-viscosity modifiers).

Lubricating oil compositions of the present invention may employ various polymers and/or copolymers, which may or may not be grafted by maleic anhydride. The polymers and/or copolymers may be employed at an amount from about 0.1 to about 10 wt. % of the lubricating oil composition. An exemplary lubricating oil composition of the present invention comprises about 7.5 wt. % of an ethylene propylene copolymer viscosity index modifier.

2. Friction Modifiers

Lubricating oil compositions of the present invention further comprise a sulfur-containing molybdenum compound. Certain sulfur-containing organo-molybdenum compounds are known to modify friction in lubricating oil compositions, while also offering antioxidant and antiwear credits. Examples of such oil soluble organo-molybdenum compounds include dithiocarbamates, dithiophosphates, dithiophosphinates, xanthates, thioxanthates, sulfides, and the like, and mixtures thereof.

Oil-soluble or dispersible trinuclear molybdenum compounds can be prepared by reacting in the appropriate liquid(s)/solvent(s) a molybdenum source such as $(NH_4)_2Mo_3S_{13}n(H_2O)$, where n varies between 0 and 2 and includes non-stoichiometric values, with a suitable ligand source such as a tetralkylthiuram disulfide. Other oil-soluble or dispersible trinuclear molybdenum compounds can be formed during a reaction in the appropriate solvent(s) of a molybdenum source, such as of $(NH_4)_2Mo_3S_{13}.n(H_2O)$, a ligand source such as tetralkylthiuram disulfide, dialkyldithiocarbamate, or dialkyldithiophosphate, and a sulfur-abstracting agent such as cyanide ions, sulfite ions, or substituted phosphines. Alternatively, a trinuclear molybdenum-sulfur halide salt such as $[M']_2[MO_3S_7A_6]$, where M' is a counter ion, and A is a halogen such as Cl, Br, or I, may be reacted with a ligand source such as a dialkyldithiocarbamate or dialkyldithiophosphate in the appropriate liquid(s)/solvent(s) to form an oil-soluble or dispersible trinuclear molybdenum compound. The appropriate liquid/solvent may be, for example, aqueous or organic.

The terms "oil-soluble" or "dispersible" used herein do not necessarily indicate that the compounds or additives are soluble, dissolvable, miscible, or capable of being suspended in the oil in all proportions. These do mean, however, that they are, for instance, soluble or stably dispersible in oil to an extent sufficient to exert their intended effect in the environment in which the oil is employed. Moreover, the additional incorporation of other additives may also permit incorporation of higher levels of a particular additive, if desired.

An exemplary lubricating oil composition of the present invention employs a molybdenum succinimide complex as friction modifier. Of the lubricating oil composition, the molybdenum complex may constitute from about 0.15 to about 0.55 wt. %, preferably from about 0.28 to about 0.45 wt. %. The exemplary lubricating oil composition of the present invention comprises about 0.30 wt. % of a molybdenum succinimide complex.

3. Other Additives

Other additives may be incorporated into the compositions of the invention to satisfy the particular performance requirements associated with low SAPS applications in automotive engines. Examples of such other additives include, for example, rust inhibitors, anti-foaming agents, and seal fixes or seal pacifiers.

Rust inhibitor or anticorrosion agents may be a nonionic polyoxyethylene surface active agent. Nonionic polyoxyethylene surface active agents include, but are not limited to, polyoxyethylene lauryl ether, polyoxyethylene higher alcohol ether, polyoxyethylene nonylphenyl ether, polyoxyethylene octylphenyl ether, polyoxyethylene octyl stearyl ether, polyoxyethylene oleyl ether, polyoxyethylene sorbitol monostearate, polyoxyethylene sorbitol mono-oleate, and polyethylene glycol monooleate. Rust inhibitors or anticorrosion agents may also be other compounds, which include, for example, stearic acid and other fatty acids, dicarboxylic acids, metal soaps, fatty acid amine salts, metal salts of heavy sulfonic acid, partial carboxylic acid ester of polyhydric alcohols, and phosphoric esters. An exemplary lubricating oil composition of the present invention comprises a calcium stearate salt.

Foam inhibitors typically include alkyl methacrylate polymers and dimethyl silicone polymers. Exemplary compositions of the present invention contain silicon-based foam inhibitors in amounts ranging from about 5 to about 40 ppm, preferably from about 8 to about 35 ppm, more preferably from about 10 to about 25 ppm, based on the total weight of the composition.

Seal fixes are also termed seal swelling agents or seal pacifiers. They are often employed in lubricant or additive compositions to insure proper elastomer sealing, and prevent premature seal failures and leakages. Seal swell agents may be, for example, oil-soluble, saturated, aliphatic, or aromatic hydrocarbon esters such as di-2-ethylhexylphthalate, mineral oils with aliphatic alcohols such as tridecyl alcohol, triphosphite ester in combination with a hydrocarbonyl-substituted phenol, and di-2-ethylhexylsebacate.

Some of the above-mentioned additives can provide a multiplicity of effects; thus for example, a single additive may act as a dispersant as well as an oxidation inhibitor. These multifunctional additives are well known.

When lubricating compositions contain one or more of the above-mentioned additives, each additive is typically blended into the base oil in an amount that enables the additive to provide its desired function. It may be desirable, although not essential, to prepare one or more additive concentrates comprising additives (concentrates sometimes being referred to as additive packages) whereby several additives can be added simultaneously to the oil to form the lubricating oil composition. The final composition may employ from about 5 to about 30 wt. %, preferably about 5 to about 25 wt. %, typically about 10 to about 20 wt. % of the concentrate, the remainder being the oil of lubricating viscosity. The components can be blended in any order and can be blended as combinations of components.

This invention will be further understood by reference to the following examples, which are not to be considered as limitative of its scope.

EXAMPLES

The following examples are provided to illustrate the present invention without limiting it. While the present invention has been described with reference to specific embodiments, this application is intended to encompass various changes and substitutions that may be made by those skilled in the art.

Oil A and Comparative Oil B were prepared and tested for thermal stability in three art-accepted bench tests. The first bench test was the CEC-L-85-T-99 PDSC Thermal Stability Test, which measured the oxidation tendencies of Oil A and Comparative Oil B. In that test, a small amount of Oil A or Comparative Oil B was weighed into a sample pan and placed in a test cell. The cell was then heated to a specified temperature and pressurized with air. The cell was held at that temperature and pressure until an exothermic reaction occurred. The extrapolated onset time was reported as the oxidation induction time. The pass/fail minimum limit for this test is 35 minutes.

The second bench test was the Oxidator BX 1414 Test, which measured the amounts of oxygen absorbed by Oil A and Comparative Oil B as a function of time. Accordingly, the results from this test indicated the readiness of each oil to take up oxygen. The lubricating oils were vigorously stirred in the presence of oxygen at 340° F. The test was run until there was a "rapid oxygen uptake," which, as typically defined, refers to the length of time it takes for every 100 grams of oil sample to take up 6 liters of oxygen. An oxidation catalyst, a metal naphthenate, was used to accelerate oxidation.

The third bench test was the Panel Coker Deposit Test, which determined the tendencies for Oil A and Comparative Oil B to form deposits when the engines housing those oils were operated, at elevated temperatures. A small amount of Oil A or Comparative Oil B was placed in a test vessel. The test vessel was then heated to a temperature of about 370° C. In each vessel, a metal comb, the teeth of which were part soaked in the oil, was rotated at the speed of about 1100 rpm, projecting the oil onto the test plate intermittently for a period of 15 seconds every minute. The test plate was held at a temperature of about 300° C. Meanwhile, air was flown through the vessel at a rate of about 12 liters per hour. The oil level in the vessel was adjusted so that it remained constant. The test lasted about 48 hours. The deposit formed at four positions on the test plate was weighed and recorded.

Oil A: Lubricating oil composition was prepared comprising about 28.69 wt. % of a first FTBO that had a kinematic viscosity of about 4.1 cSt at 100° C. and about 48.86 wt. % of a second FTBO that had a kinematic viscosity of about 7.9 cSt at 100° C. The oil composition further comprised a bissuccinimide dispersant, a low TBN sulfonate detergent, a high TBN phenate detergent, a zinc dihydrocarbyl dithiophosphate, a moly succinimide, an antioxidant, a corrosion inhibitor, a silicon based foam inhibitor, a polyolester, and calcium stearate. Components of Oil A are listed in Table 1. Oil A had a sulfated ash content of about 0.8 wt. %, sulfur content of about 0.2 wt. % and phosphorus content of about 0.07 wt. %.

Comparative Oil B: The formulation of Oil A was duplicated except that Oil B did not comprise the two FTBOs. Instead, two Group III base oils were used in the amount of about 68.72 wt. % and about 4.33 wt. %. Components of Comparative Oil B are also listed below in Table 1. Oil B had a sulfated ash content of about 0.8 wt. %, sulfur content of about 0.2 wt. % and phosphorus content of 0.07 wt. %.

Comparing the results obtained from the tests described above, namely, the CEC L-85-T-99 test, the Oxidator BX 1414 test, and the Panel Coker Deposit test. Oil A exhibited surprising and dramatic improvement in thermal stability, and especially in the capacity to resist oxidation and deposit buildup, over Comparative Oil B. The results of the tests are listed in Table 2.

TABLE 1

| Components: SAE: 5W40 | | |
|---|---|---|
| Samples | Oil A | Oil B |
| Bissuccinimide Dispersant | 6.5 wt. % | 6.5 wt. % |
| Low TBN Calcium Sulfonate Detergent | 4 mM | 4 mM |
| Calcium Stearate | 35 mM | 35 mM |
| High TBN Sulfurized Calcium Phenate Detergent | 10 mM | 10 mM |
| Zinc dialkyldithiophosphate | 11.5 mM | 11.5 mM |
| Moly Succinimide | 0.3 wt. % | 0.3 wt. % |
| Di-$C_8$-diphenylamine | 0.4 wt. % | 0.4 wt. % |
| Borated 2-ethylhexanol corrosion inhibitor | 0.5 wt. % | 0.5 wt. % |
| Silicon-based foam inhibitor | 25 ppm | 25 ppm |
| Polyolester | 1.5 wt. % | 1.5 wt. % |
| Ethylene-propylene copolymer VII | 7.4 wt. % | 11.9 wt. % |
| Diluent Oil | 0.74 wt. % | 0.74 wt. % |
| FTBO 1 (4.1 cSt at 100° C.) | 28.69 wt. % | |
| FTBO 2 (7.9 cSt at 100° C.) | 48.86 wt. % | |
| Group III Base Oil NSTE SW3043XV | | 68.72 wt. % |
| Group III Base Oil NSTE SW3060XV | | 4.33 wt. % |

TABLE 2

| Test Results: | | |
|---|---|---|
| Test Results | Oil A | Oil B |
| CEC L-85-T-99 Test (ACEA E7 Pass/Fail Standard = 35 minutes) | 173.1 minutes | 150.3 minutes |
| Oxidator BX 1414 Test | | |
| Time to Rapid Oxygen Uptake | 63.5 hours | 42 hours |
| Volume of Oxygen @ Rapid Oxygen Uptake | 1.6 liters | 1.6 liters |
| Time to Reach 1 liter Oxygen/100 g of oil | 40.86 hours | 30.01 hours |
| Panel Coker Deposit Test | | (in duplicates) |
| Position 1 on Test Plate | 39.7 mg | 264.9/356.6 mg |
| Position 2 on Test Plate | 39.2 mg | 278.2/347.6 mg |
| Position 3 on Test Plate | 41.5 mg | 314.0/325.4 mg |
| Position 4 on Test Plate | 33.4 mg | 276.6/391.5 mg |
| Average | 38.45 mg | 283.4/355.3 mg |

What is claimed is:

1. An automotive engine lubricant composition, which comprises an admixture of: (a) a major amount of one or more Fischer-Tropsch Base Oils (FTBOs), wherein the major amount of said one or more FTBOs is greater than about 60 wt. % based on the total weight of said composition; (b) one or more ashless dispersants present in an amount from about 0.5 wt. % to about 10 wt. % of based on the total weight of the composition; (c) a mixture of a low overbased calcium sulfonate detergent having a total base number (TBN) of less than 100 and a high overbased calcium phenate detergent having a TBN of greater than 100, wherein the mixture of the low-overbased calcium sulfonate detergent and the high-overbased calcium phenate detergent is present from about 0.05 mM to about 16 mM in said lubricant composition; (d) one or more metal dihydrocarbyldithiophosphate anti-wear additives present in an amount that contributes about 0.03 to about 0.075 wt. % of phosphorus to the composition; and (e) from about 0.20 to about 0.80 wt. of a phenolic antioxidant, or an aminic antioxidant, or a combination thereof, based on the total weight of the lubricant composition; wherein said automotive engine lubricant composition has a sulfur content of at or below about 0.3 wt. %, a phosphorus content of at or below about 0.08 wt. %, and a sulfated ash content of at or below about 1.0 wt. %, based on the total weight of said lubricant composition, and wherein the one or more FTBOs each has paraffinic hydrocarbon components with less than about 12 alkyl branches per 100 carbons.

2. The composition of claim 1, further comprising one or more additives selected from: friction modifiers, corrosion inhibitors, viscosity index improvers, anti-foaming agents, seal fixes, pour point depressants, and multi-functional additives.

3. The composition of claim 1, further comprising one or more non-FTBO base oils, wherein the thermal stability of the lubricant composition is not negatively affected by the non-FTBO base oils.

4. The composition of claim 1, wherein the sulfur content of the composition is at or below about 0.2 wt. %, based on the total weight of said composition.

5. The composition of claim 4, wherein the sulfur content of the composition is at or below about 0.1 wt. %, based on the total weight of said composition.

6. The composition of claim 1, wherein the phosphorus content of the composition is at or below about 0.07 wt. %, based on the total weight of said composition.

7. The composition of claim 6, wherein the phosphorus content of the composition is at or below about 0.05 wt. %, based on the total weight of said composition.

8. The composition of claim 1, wherein the sulfated ash content of the composition is at or below about 0.8 wt. %, based on the total weight of said composition.

9. The composition of claim 8, wherein the sulfated ash content of the composition is at or below about 0.5 wt. %, based on the total weight of said composition.

10. The composition of claim 9, wherein the sulfated ash content of the composition is at or below about 0.45 wt. %, based on the total weight of said composition.

11. The composition of claim 1, wherein the amount of the one of more FTBOs is greater than about 70 wt. % based on the total weight of said composition.

12. The composition of claim 1, wherein the one or more FTBOs each has a kinematic viscosity of no less than about 2 cSt at 100° C.

13. The composition of claim 12, wherein the one or more FTBOs each has a kinematic viscosity of no less than about 4 cSt at 100° C.

14. The composition of claim 1, wherein the one or more FTBOs each has a viscosity index of no less than 100.

15. The composition of claim 1, wherein the one or more FTBOs each has a pour point of no higher than about 20° C.

16. The composition of claim 15, wherein the one or more FTBOs each has a pour point of no higher than about −8° C.

17. The composition of claim 1, wherein the one or more FTBOs each has a cloud point of no higher than about 2° C.

18. The composition of claim 1, wherein the one or more FTBOs each has paraffinic hydrocarbon components with less than about 10 alkyl branches per 100 carbons.

19. The composition of claim 1, which takes more than about 7 hours to absorb 1 liter of oxygen per 100 grams of oil under the standard Oxidator BN test conditions.

20. The composition of claim 1, wherein one of the one or more ashless dispersants is a bissuccinimide.

21. The composition of claim 20, wherein the bissuccinimide ashless dispersant is derived from one or more polyisobutylene succinic anhydrides.

22. The composition of claim 1, wherein the aminic antioxidant is a diphenylamine.

23. The composition of claim 1, wherein the metal dihydrocarbyldithiophosphate is a zinc dialkylthiophosphate.

24. The composition of claim 1, wherein the one or more ashless dispersants contribute about 0.08 to about 0.42 wt. % of nitrogen atoms to the composition.

25. The composition of claim 1, wherein the metal-containing detergent is a calcium overbased detergent.

26. The composition of claim 2, wherein one of the one or more friction modifiers is a molybdenum succinimide complex.

27. The composition of claim 2, wherein the amount of the one or more friction modifiers is about 0.15 wt. % to about 0.55 wt. %.

28. The composition of claim 2, wherein one of the one or more corrosion inhibitors is a calcium-stearate salt.

29. The composition of claim 2, wherein one of the one or more foam inhibitors is a silicon-based foam inhibitor.

30. A method of improving the performance of an automotive engine under elevated temperatures, said method comprising: operating the engine with a low phosphorus, low sulfur and low sulfated ash automotive engine lubricant composition, which comprises: (a) a major amount of one or more FTBOs, wherein the major amount of said one or more FTBOs is greater than about 60 wt. % based on the total weight of said composition; (b) one or more ashless dispersants present in an amount from about 0.5 wt. % to about 10 wt. % of based on the total weight of the composition; (c) a mixture of a low overbased calcium sulfonate detergent having a TBN of less than 100 and a high overbased calcium phenate detergent having a TBN of greater than 100, wherein the mixture of the low-overbased calcium sulfonate detergent and the high-overbased calcium phenate detergent is present from about 0.05 mM to about 16 mM in said lubricant composition; (d) from about 0.20 to about 0.80 wt. % of a phenolic antioxidant, or an aminic antioxidant, or a combination thereof, based on the total weight of the lubricant composition; and (e) one or more metal dihydrocarbyldithiophosphate anti-wear additives present in an amount that contributes about 0.03 to about 0.075 wt. % of phosphorus to the composition; wherein said low phosphorus, low sulfur and low sulfated ash automotive engine lubricant composition has a sulfur content of at or below about 0.3 wt. %, a phosphorus content of at or below about 0.08 wt. %, and a sulfated ash content of at or below about 1.0 wt. %, based on the total weight of said lubricant composition, and wherein the one or more FTBOs each has paraffinic hydrocarbon components with less than about 12 alkyl branches per 100 carbons.

31. The method of claim 30, wherein the low phosphorus, low sulfur and low sulfated ash lubricant composition further comprises one or more additives selected from: friction modifiers, corrosion inhibitors, pour point depressants, viscosity index modifiers, anti-foaming agents, seal fixes, and multi-functional additives.

32. The method of claim 30, wherein the low phosphorus, low sulfur and low sulfated ash lubricant composition has a sulfur content of at or below about 0.2 wt. %.

33. The method of claim 32, wherein the low phosphorus, low sulfur and low sulfated ash lubricant composition has a sulfur content of at or below about 0.1 wt. %.

34. The method of claim 30, wherein the low phosphorus, low sulfur and low sulfated ash lubricant composition has a phosphorus content of at or below about 0.07 wt. %.

35. The method of claim 34, wherein the low phosphorus, low sulfur and low sulfated ash lubricant composition has phosphorus content of at or below about 0.05 wt. %.

36. The method of claim 30, wherein the low phosphorus, low sulfur and low sulfated ash lubricant composition has a sulfated ash content at or below about 0.8 wt. %.

37. The method of claim 36, wherein the low phosphorus low sulfur and low sulfated ash lubricant composition has a sulfated ash content at or below about 0.5 wt. %.

38. The method of claim 37, wherein the low phosphorus, low sulfur and low sulfated ash lubricant composition has a sulfated ash content at or below about 0.45 wt. %.

39. The method of claim 30, wherein the amount of the one or more FTBOs is at or above about 70 wt. %, based on the total weight of the lubricant composition.

40. A method of operating an automotive engine provided with after-treatment devices, which method comprises lubricating said engine with the lubricant composition according to claim 1.

41. The method according to claim 40, wherein said automotive engine is selected from; (1) a light duty diesel-fueled automotive engine; (2) a heavy duty diesel-fueled automotive engine; and (3) a gasoline-fueled automotive engine.

42. The method according to claim 40, wherein said after-treatment devices are selected from particulate traps and catalytic converters.

43. A method of making an automotive engine lubricant composition comprising blending the following components: (a) a major amount of one or more FTBOs, wherein the major amount of said one or more FTBOs is greater than about 60 wt. % based on the total weight of said composition; (b) one or more ashless dispersants present in an amount from about 0.5 wt. % to about 10 wt. % of based on the total weight of the composition; (c) a mixture of a low overbased calcium sulfonate detergent having a TBN of less than 100 and a high overbased calcium phenate detergent having a TBN of greater than 100, wherein the mixture of the low-overbased calcium sulfonate detergent and the high-overbased calcium phenate detergent is present from about 0.05 mM to about 16 mM in said lubricant composition; (d) one or more metal dihydrocarbyldithiophosphate anti-wear additives present in an amount that contributes about 0.03 to about 0.075 wt. % of phosphorus to the composition; and (e) from about 0.20 to about 0.80 wt. % of a phenolic antioxidant, or an aminic antioxidant, or a combination thereof, based on the total weight of the lubricant composition; and resulting in an automotive engine lubricant composition with a sulfur content of at or below about 0.3 wt. %, a phosphorus content of at or below about 0.08 wt. %, and a sulfated ash content of at or below about 1.0 wt. %, wherein the one or more FTBOs each has paraffinic hydrocarbon components with less than about 12 alkyl branches per 100 carbons.

44. The method of claim 43, where one or more additives selected from: friction modifiers, viscosity index modifiers, corrosion inhibitors, anti-foaming agents, seal fixes, pour point depressants, and multi-functional additives, are further blended into said lubricant composition.

45. The method of claim 43, wherein the lubricant composition has a sulfur content of at or below about 0.2 wt. %.

46. The method of claim 45, wherein the lubricant composition has a sulfur content of at or below about 0.1 wt. %.

47. The method of claim 43, wherein the lubricant composition has a phosphorus content of at or below about 0.07 wt. %.

48. The method of claim 47, wherein the lubricant composition has a phosphorus content of at or below about 0.05 wt. %.

49. The method of claim 43, wherein the lubricant composition has a sulfated ash content at or below about 0.8 wt. %.

50. The method of claim 49, wherein the lubricant composition has a sulfated ash content at or below about 0.5 wt. %.

51. The method of claim 50, wherein the lubricant composition has a sulfated ash content at or below about 0.45 wt. %.

52. The method of claim 43, wherein the amount of one or more FTBOs is at or above about 70 wt. %, based on the total weight of the lubricant composition.

* * * * *